US007146915B2

(12) United States Patent
Magaldi

(10) Patent No.: US 7,146,915 B2
(45) Date of Patent: Dec. 12, 2006

(54) EXTRACTOR/COOLER OF LOOSE MATERIALS THROUGH THE USE OF CONVEYOR BELT EQUIPPED WITH BORED AND WINGED PLATES

(75) Inventor: Mario Magaldi, Salerno (IT)

(73) Assignee: Magaldi Ricerche e Brevetti S.r.l., Salerno (IT)

( * ) Notice: Subject to any disclaimer, the term of this patent is extended or adjusted under 35 U.S.C. 154(b) by 0 days.

(21) Appl. No.: 10/505,060

(22) PCT Filed: Feb. 19, 2003

(86) PCT No.: PCT/EP03/01690

§ 371 (c)(1),
(2), (4) Date: Feb. 4, 2005

(87) PCT Pub. No.: WO03/071189

PCT Pub. Date: Aug. 28, 2003

(65) Prior Publication Data

US 2005/0115477 A1 Jun. 2, 2005

(30) Foreign Application Priority Data

Feb. 21, 2002 (IT) ..... MI2002A0353

(51) Int. Cl.

*F23J 1/02* (2006.01)

(52) U.S. Cl. ..... 110/165 R; 432/77

(58) Field of Classification Search ..... 110/165 R, 110/166.1, 67, 168

See application file for complete search history.

(56) References Cited

U.S. PATENT DOCUMENTS 5,713,345 A * 2/1998 Bentsen et al. ..... 126/152 B
6,082,442 A * 7/2000 Michelbrink ..... 165/104.18
6,230,633 B1 * 5/2001 Magaldi et al. ..... 110/189

* cited by examiner

*Primary Examiner*—Kenneth Rinehart
(74) *Attorney, Agent, or Firm*—Olson & Hierl, Ltd.

(57) ABSTRACT

The cooling of the material is mainly achieved through the convective thermal exchange between the loose hot material and the cooling air flow blown in from the outside, and through the conductive thermal exchange between the same material (3) and the conveyor belt (2). In order to improve the efficiency of the cooling process appropriate slots (16) are made into the plates of the conveyor belt, through which the cooling air can be made to flow so as to reach the base of the travelling continuous bed consisting of hot material. Furthermore the abovementioned plates can be equipped with appropriate extensions which operate while immersed into the conveyed material, thus increasing the surface suitable for the conductive thermal exchange.

6 Claims, 4 Drawing Sheets

EXTRACTOR/COOLER OF LOOSE MATERIALS THROUGH THE USE OF CONVEYOR BELT EQUIPPED WITH BORED AND WINGED PLATES

The present invention is about an extractor/cooler of fine grain size solid loose materials such as heavy ashes produced by fluidized bed boilers, foundry sand, sintered powders, cements, slogs or fine grain size minerals generated in the various industrial processes of burning, baking, sintering, etc.

Today the system more used for the extraction and cooling of the ashes in the fluidized bed boilers, coming from the combustion chambers at temperature close to 800–900° C., is made of a scroll internally and externally cooled with water. The use of said system still has considerable inconvenience, which are hereafter briefly described:

- High wear due to the abrasive action that the ash exerts on the life of the scroll, because of the high content of abrasive material like silica;
- Danger because of the considerable wear of sudden breakings of the metal with water losses and the possibility of explosion due to the fast evaporation of the water;
- Reduction of the MTBF (Mean Time Between Failure) due to the quick wear to which the system is subject;
- The possibility of sudden jamming of the scroll because of the hard materials of greater dimensions than the passing port;
- Dispersion into the environment of all the thermal content of the ashes which can not be recovered.

The abovementioned problems and the inconveniences are solved by the extractor/cooler of the present invention having the features recited in the characterizing part of the appended claims.

The characteristics, objects and advantages of the invention will be better highlighted in a not limiting way by the following description and by the annexed drawings corresponding to some embodiments, wherein.

Figure 1:
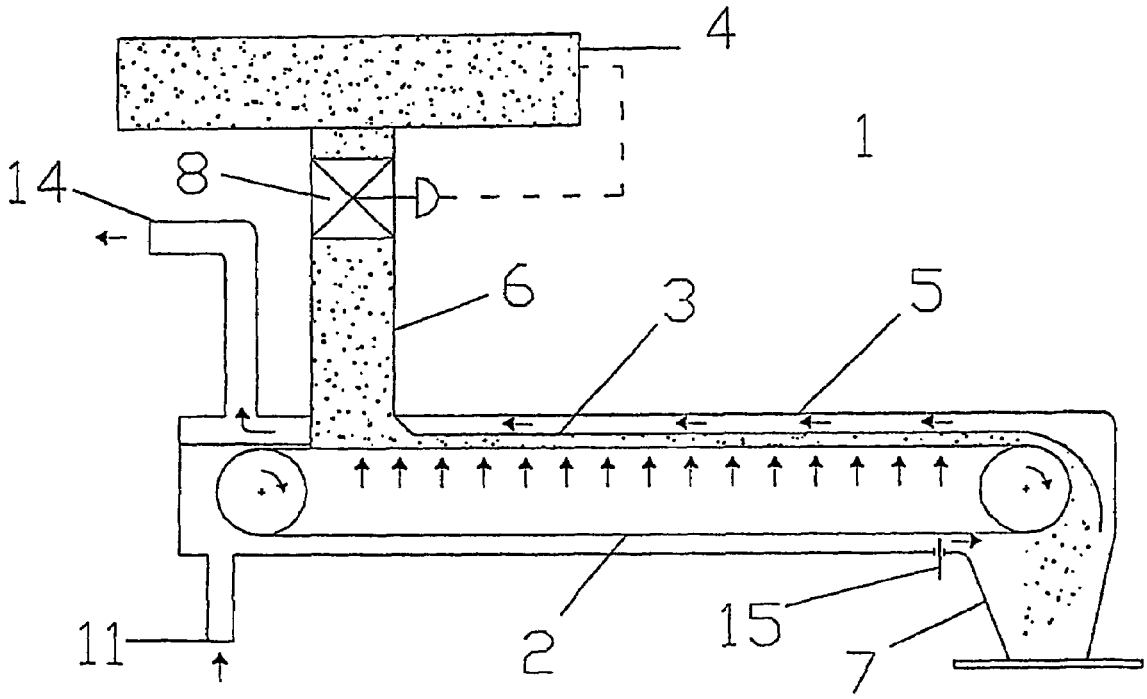
FIG. 1 is a diagrammatic view of a system of extractor/cooler of hot loose materials for fluidized bed boilers according to the present invention.
Figure 2:
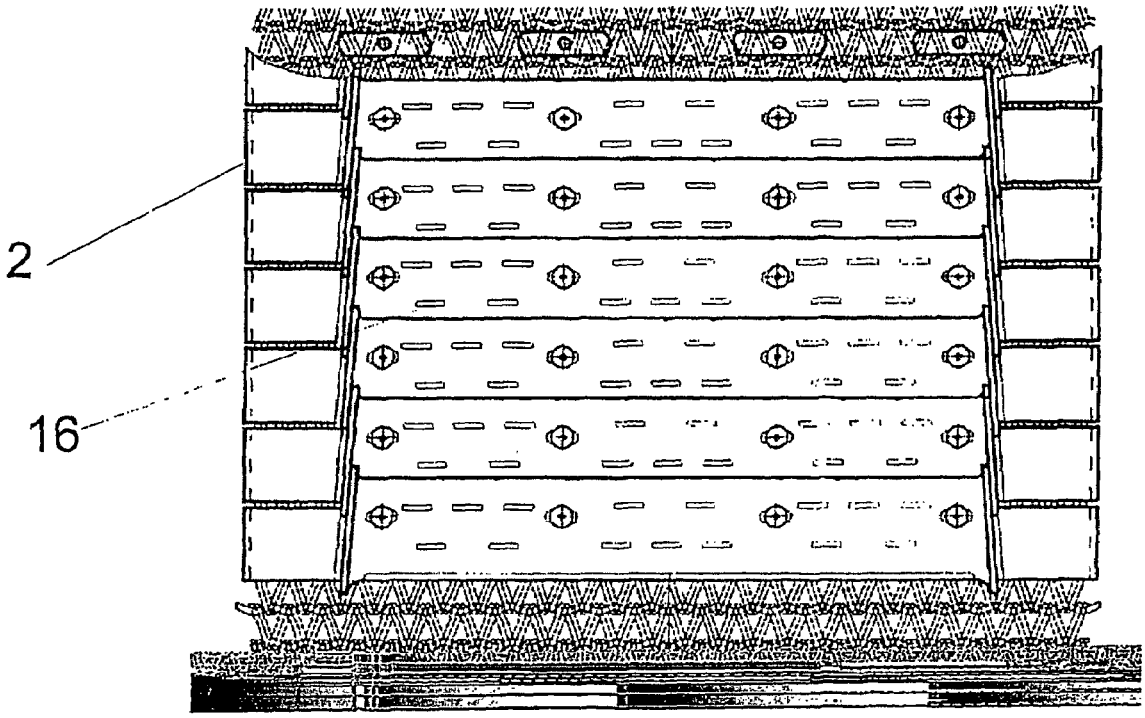
FIG. 2 is a diagrammatic view of the driving means with a metal belt conveyor equipped with slots in order to allow the passage of the cooling air inside the layer of conveyed hot material.
Figure 3:
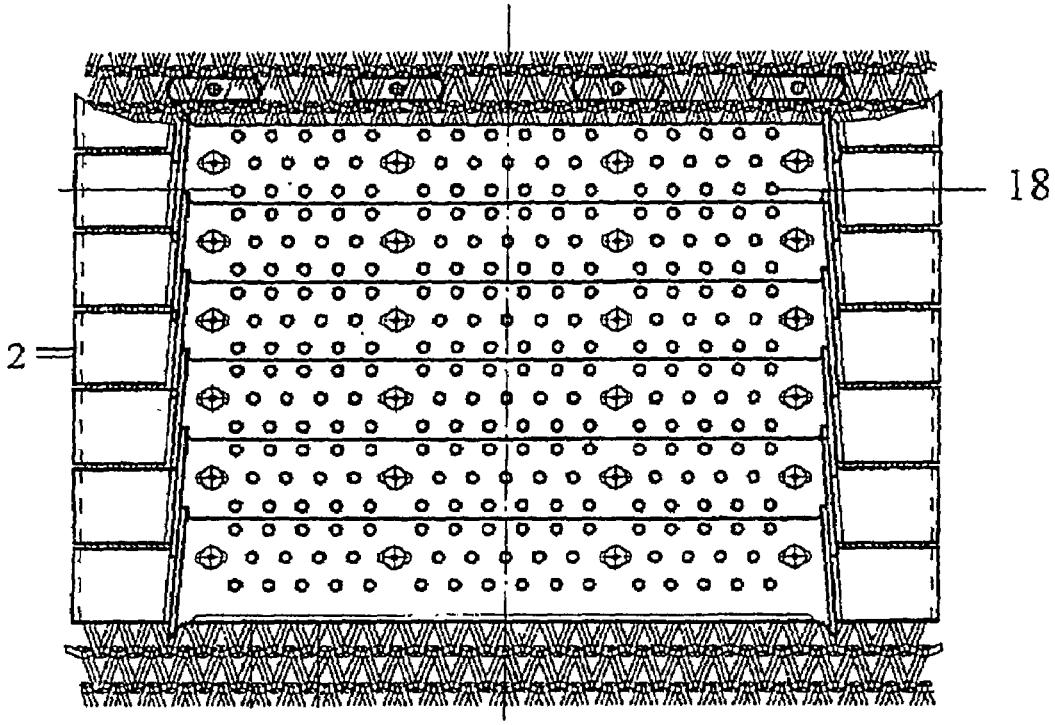
FIG. 3 is a diagrammatic view of the driving means with a metal belt conveyor whose plates are equipped with pins in order to increase the cooling efficiency.
Figure 4:
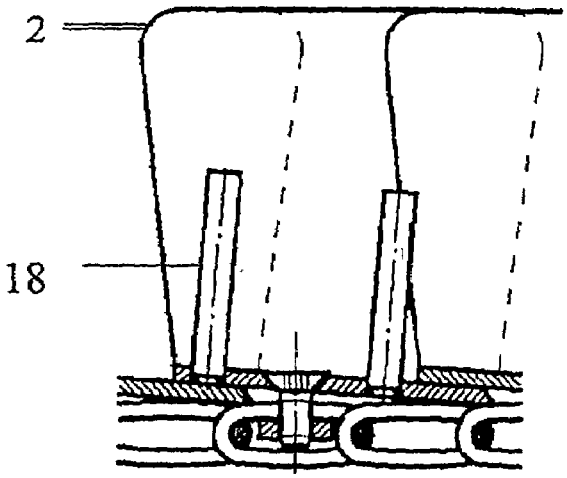
Figure 5:
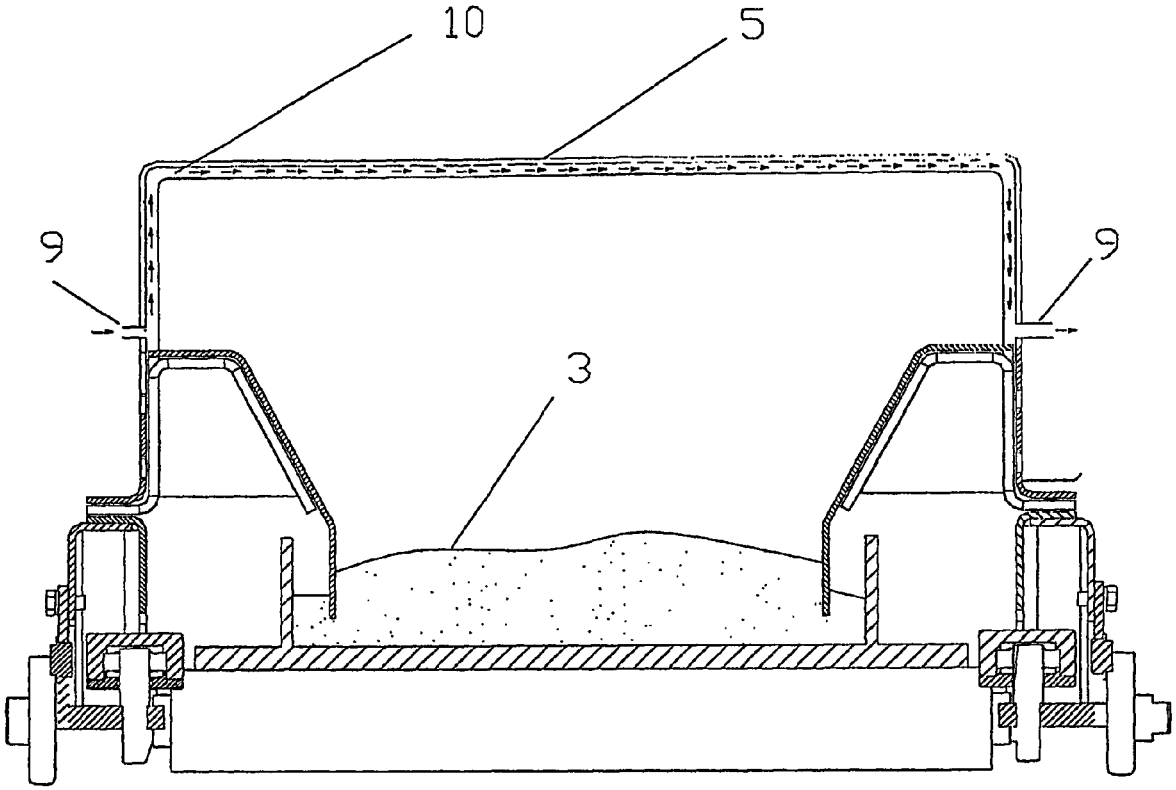

FIG. 4 is a diagrammatic view of the section of the plates of the driving means with a metal belt conveyor equipped with pins in order to increase the cooling efficiency; and FIG. 5 is a diagrammatic view of the section of the conveyor equipped in its upper and side part with a space 10 wherein the water 9 flows for the cooling of the conveyed material 3.

The extractor/cooler 1 described in the present invention uses the extraction and cooling of hot loose materials 3, particularly such as heavy ashes and other combustion products coming from the boiler 4, a driving means with a steel metal belt conveyor 2 appropriately inserted into a sealed metal container 5 and controlled to move through proper powered means (not shown in the figures relative to the present application).

The ash 3 due to the gravitational force leaves the combustion chamber of the boiler 4 through the vertical runner 6 and lays down on the lower metal belt conveyor 2 where it lies on forming a continuous bed moving towards the discharge area. The distance between the belt conveyor 2 and the runner 6 must be such to guarantee the passage of the biggest conceivable bits of the material 3.

During the operation of the system, the runner 6 must be always full of material in order to guarantee the necessary separation between the environment of the combustion chamber of the boiler 4 and the environment of the metal container 5. For this reason, a level gauge acting on the speed of travel of the belt keeps the level constant. Furthermore, if the level of ash of the boiler 4 falls below the critical threshold an on-off valve 8 activates, which by closing itself it prevents the combustion chamber to communicate with the metal container 5.

A valve is assembled on the runner 6, in the discharge area of the material 3 on the metal belt conveyor 2, in order to provide for the following functions:

- Building a barrier to prevent emptying the discharge pipe 6 of the ash 3 when the latter turns out to be extremely fluid;
- Allowing the passage of material 3 having exceptionally big bits.

The thickness of layer of material 3 on the conveyor belt 2 is adjusted with respect to the grain size of the ash and with respect to the specific cooling needs. Once said thickness is defined, the capacity of the ash 3 is metered by varying the speed of travel of the metal belt 2.

The cooling air can be fed inside the metal container 5 through a proper fan or it can also be collected by the delivery of one or more fans of the primary or secondary air which already feed the boiler.

The air intake 11 through which the cooling air flows is located in the lower back area of the metal container 5, before the runner 6 of the material 3.

The air flow is blown in by the intake 11 where a part of it flows on the bottom of the container 5 below the conveyor belt 2 towards the discharge area 7 where is mixed to the first flow, while the remaining part flows through the slots 16 made into the plates of the conveyor belt 2, thus penetrating through the whole thickness of the bed of hot material 3, cooling not only its base but the inner layer as well.

The shape, the number and the arrangement of the slots 16 in the plates of the metal conveyor belt 2 must be defined with respect to the kind, the amount, and mainly the grain size of the conveyed material 3, so as to avoid that this latter would fall either on the lower parts of the belt 2 or on the bottom of the metal container 5.

The portion of air used for the two cooling fractions of the second flow is appropriately metered through a regulating valve 15 placed in the lower part of the metal container 5 next to the discharge area 7.

The heated air can thus be inserted into the combustion chamber of the boiler 4 through the runner 14 mixing it to the primary or secondary combustion air, therefore using again the thermal air recovered during the cooling phase of the hot material 3, or it is possible to eject the air, after its proper filtering, directly into the atmosphere.

The cooling of the ashes 3 also occurs through conductive thermal exchange, as the metal conveyor belt 2 acts like a regenerating heat exchanger, absorbing the heat in the forward run towards the discharge area 7 and yielding it to the air in the return run towards the runner 6.

With respect to the specific operative conditions, if, for example, unloading the ashes at low temperatures, or with high capacities of ashes is needed, when there is no possibility of having a length of the extractor/cooler 1 fit to the cooling needs, increasing the thermal exchange of the conveyed material 3 could turn out to be necessary. This condition can be achieved by applying a number of extensions 18 on the plates of the metal conveyor belt 2 in order to increase the surface of thermal exchange between said conveyor belt 2 and the hot conveyed material 3, thus further raising the cooling. The size, the number and the arrangement of the extensions 18, can vary according to the type of conveyed material and to the specific cooling needs.

In order to increase the degree of cooling of the ash, there is the possibility of cooling the upper and side area of the metal container 5 with a water flow 9 which flows inside the space 10 made in the upper and side part of the metal container 5. As a matter of fact, the hot material transported by the conveyor belt transmits heat by radiance to the metal container in the upper and side part.

Regarding said description, it must be noticed that several modifications, additions, adjustments, variations and substitutions of elements could be made to the illustrative embodiments previously described in an explanatory but not limiting way with other functionally equivalent elements, without falling out of the scope of protection as also recited in the following appended claims.

The invention claimed is:

1. An extractor/cooler (1) of solid loose hot materials (3) produced either by fluidized bed boilers (4) or by various industrial processes basically comprising a sealed metal container means (5) connected to the boiler (4) through a runner (6), inside said container (5) a motorized driving means with a metal belt conveyor (2) having plates with appropriate slots (16) that retain the solid loose hot materials (3) but permit cooling air flow through the loose hot materials (3) and extension means (18) the hot materials (3) coming from the runner (6) being received on said belt conveyor (2), due to the gravitational force from the combustion chamber thus forming a continuous bed of material (3) whose cooling is carried out through the convective thermal exchange with air flows, and through conductive thermal exchange with the metal belt conveyor (2), and/or through thermal exchange with a the water cooled upper and side part of the container (5); said extension means (18) increasing conductive thermal exchange surface between the loose hot materials (3) and metal belt conveyor (2).

2. The extractor/cooler according to claim 1 characterized in that the portion of air flow entering the metal container (5) from the air intake (11) which flows through the slots (16) made on the plates of the belt (2) is adjustable through an appropriate regulating valve (15).

3. The extractor/cooler according to claim 1, characterized in that the driving means with a metal belt conveyor (2) consists of a regenerating heat exchanger which absorbs the heat from the material (3) during the forward run towards the discharge area (7) and yields heat to the air in the return run.

4. The extractor/cooler according to claim 1, characterized in that said extractor/cooler (1) allows the recovery of the energy removed from the hot material (3), the recovery occurring by inserting the heated air from the material (3) into the runners of the primary or secondary combustion air leading to the combustion chamber of the boiler (4).

5. The extractor/cooler according to claim 1, characterized in that the cooling of the conveyed material (3) is increased by the thermal exchange between the upper and side area of the container (5) cooled by water (9) and the hot material (3), and is achieved with a space (10) wherein the water (9) removes the amount of heat irradiated by the material towards the metal container (5).

6. The extractor/cooler according to claim 1 wherein the extension means (18) are substantially normal to the metal belt conveyor (2).

* * * * *